United States Patent [19]

Buckley et al.

[11] Patent Number: 4,961,815

[45] Date of Patent: Oct. 9, 1990

[54] TAPE WRAPPING APPARATUS FOR WRAPPING A BUNDLE OF WIRES

[75] Inventors: Richard A. Buckley, Camp Hill; Kenneth F. Folk, Harrisburg, both of Pa.

[73] Assignee: AMP Incorporated, Harrisburg, Pa.

[21] Appl. No.: 303,440

[22] Filed: Jan. 27, 1989

[51] Int. Cl.[5] ..... B31F 1/00

[52] U.S. Cl. ..... 156/468; 53/588; 156/486; 156/522

[58] Field of Search ..... 156/468, 475, 486, 443, 156/425, 428, 430–432, 392, 522; 53/583, 588; 242/7.08, 6, 7.23; 57/10, 3; 100/15, 27

[56] References Cited

U.S. PATENT DOCUMENTS

| | | | |
|---|---|---|---|
| 2,834,499 | 5/1958 | Semkow | 156/486 |
| 3,414,451 | 12/1968 | Sejda | 156/468 X |
| 3,988,193 | 10/1976 | Arens | 156/486 X |
| 4,086,117 | 4/1978 | Pearsall | 156/486 X |
| 4,835,858 | 6/1989 | Adlon et al. | 29/748 X |

*Primary Examiner*—David Simmons

*Attorney, Agent, or Firm*—James M. Trygg

[57] ABSTRACT

The present invention is an apparatus and method of wrapping a binding tape about a bundle of wires in an automated environment. A tape handling system is provided that de-reels and stores slack tape prior to performing the tape wrap operation. This slack type is then provided to the tape wrapping mechanism at a controlled tension to avoid stretching or breaking the tape.

9 Claims, 5 Drawing Sheets

TAPE WRAPPING APPARATUS FOR WRAPPING A BUNDLE OF WIRES

The present invention relates to automated apparatus for wrapping a binding tape about a bundle of wires.

BACKGROUND OF THE INVENTION

In the making of electrical harnesses of the type composed of a large number of discrete wires, it is desirable to bind together related groups of the wires. The binding can be done with a suitable twine, wire, plastic tie strip, tape, or other similar material. Tape, having an adhesive on one side, is becoming the preferred binding medium in the manufacture of wiring harnesses because it is effective and inexpensive to use. In an automated environment, however, proper tension of the tape during the wrapping process must be maintained to avoid stretching or breaking the tape and to ensure high quality binding of the wire bundle. Further, once the tape is cut and wrapped about a wire bundle, the free end of the supply of tape must be controlled and attached to the next binding point. If too much tension is present, when the tape is pushed into the cutting blade, the tape will stretch in the area of the cut resulting in a curled end which is very difficult to control. This problem occurs when sufficient slack is not de-reeled prior to the cutting operation. Another problem that occurs when sufficient slack is not de-reeled is the difficulty in controlling the length of the portion of the tape that is actually wrapped about the wire bundle. In order to begin the wrapping operation, the end of the tape must first be attached to the wire bundle. This is normally done by pressing the adhesive side of the tape against the side of the wire bundle. If the de-reeling forces are substantial, they may overcome the adhesive forces resulting in the tape slipping or completely releasing from the wire bundle. What is needed is a tape wrapping apparatus that will provide sufficient slack in the tape while maintaining a desired level of tension during the tape wrap operation.

SUMMARY OF THE INVENTION

The present invention is a tape wrapping apparatus and method for automatically wrapping tape about a bundle of wires for use in a machine for handling bundles of wire. The tape wrapping apparatus has a frame and a tape wrap head journaled for rotation in the frame. The tape wrap head is movable, along with the frame, in a direction toward and into engagement with the bundle of wires and in an opposite direction. A tape handling means is provided for dispensing a selected length of tape from an endless supply of tape while maintaining a desired tension on the tape. A cutter means is also provided for cutting the selected length of tape thereby leaving a free cut end on the endless supply of tape. The tape wrap head is operable to wrap the cut selected length of tape about the bundle of wires.

DESCRIPTION OF THE PREFERRED EMBODIMENT

Figures 1, 1A, 1B:
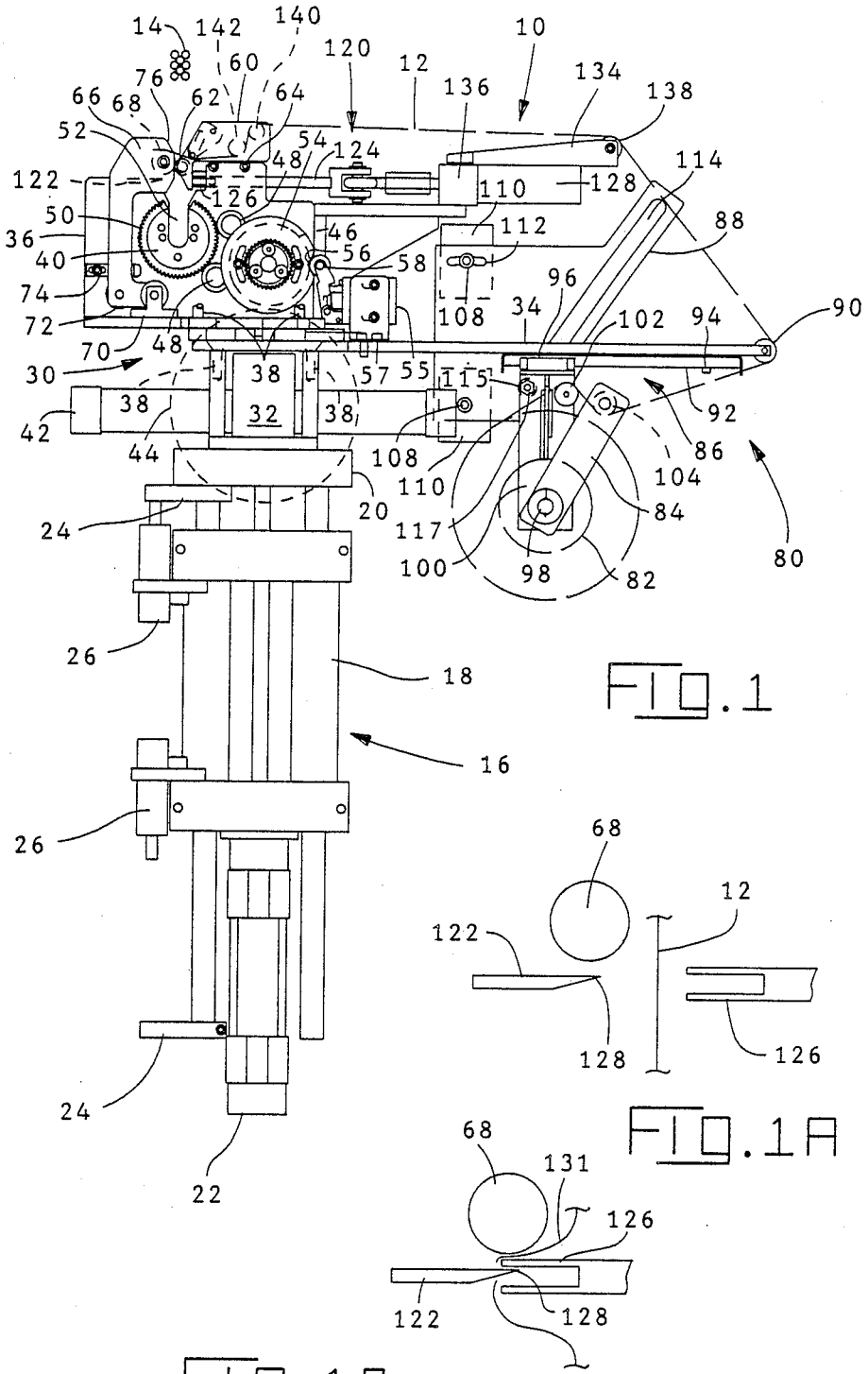
FIG. 1 is a front view of the machine showing the automatic tape wrapping apparatus in accordance with the teachings of the present invention.

There is shown in FIGS. 1 through 5 an apparatus 10 for automatically wrapping a portion of tape 12 about a bundle of wires 14. The apparatus 10 is attached to a machine for handling bundles of wire, not shown, by means of the slide 16. The tape wrapping apparatus 10, of the present invention, is suitable for use on various machines for handling bundles of wire such as for electrical wire harness making, electrical cable making, and similar applications where a number of discrete electrical wires are to be bundled together. The slide 16 has a stationary portion 18 which is rigidly attached to the machine, not shown, and a movable portion 20 which is arranged to move upwardly toward the wire bundle 14 and downwardly in an opposite direction away from the wire bundle 14, as viewed in FIG. 1. The movable portion 20 of the slide 16 may be moved by any suitable linear actuator such as an air cylinder 22 or similar device. A pair of stop plates 24 are attached to the movable portion 20 and are arranged to engage a pair of adjustable stops 26 which are attached to the stationary portion 18 for limiting movement of the slide 16 in the usual manner.

A frame 30 of the tape wrapping apparatus 10 consists of a mount 32, which is rigidly attached to the movable portion 20, a horizontal bar 34, and a vertical plate 36. The parts 32, 34, and 36 are mutually attached in any suitable manner to form a rigid frame 30, such as by welding or, as in the present example, by screw fasteners 38. The frame 30, being rigidly attached to the movable portion 20 of the slide 16, moves therewith in a direction toward and away from the wire bundle 14.

A tape wrap head 40 is journaled for rotation in the vertical plate 36 as shown in FIG. 1. The tape wrap head 40 is driven by a rotational indexer 42 which drives a relatively large diameter gear 44 which meshes with and drives a drive gear 46. A pair of spur gears 48 are arranged to mesh with the drive gear 46 and a gear surface 50 which is disposed on the periphery of the tape wrap head 40. The tape wrap head 40 includes an opening, or slot 52 which projects from the center of rotation substantially radially outwardly through the gear surface 50 for a purpose that will be explained below. Two spur gears 48 are needed to assure continued rotation of the tape wrap head 40 when either of the spur gears 48 is aligned with the opening 52. A cam 54 having a notch 56 is attached to and rotates with the drive gear 46. A control valve 55, which is attached to the horizontal bar 34 by the screw fasteners 57, has a cam follower 58 which engages the cam 54 as shown in FIG. 1. Unless the valve 55 is actuated by the follower 58 engaging the notch 56, the air cylinder 22 will not operate. This is to assure that the opening 52 faces upwardly, as viewed in FIG. 1, when the tape wrap head is caused to engage or disengage the wire bundle 14. Therefore, after each rotational cycle of the tape wrap head, in the present example, four complete revolutions of the tape wrap head constitute one cycle, the cylinder 22 is actuated to withdraw the tape wrapping apparatus 10 downwardly, away from the wire bundle 14. In the event of a failure of the control system wherein the activation of the cylinder 22 were attempted while the opening 52 is not pointed directly upward, as shown in FIG. 1, the follower 58 would not be in engagement with the notch 56 and, therefore, the control valve 55 would prevent pressurization of the air cylinder 22.

A fixed guide member 60 having a guide roller 62 is adjustably attached to the vertical plate 36 with the screw fasteners 64. The guide member 60 is adjusted so that the roller 62 is in approximate alignment with the right side of the opening 52, as viewed in FIG. 1, for a purpose that will be explained below. A movable guide member 66 having a guide roller 68 that is opposed to the roller 62, is pivotally attached to the frame 30 by means of the bracket 70 and screw fasteners 72. An adjustable spring tension mechanism 74 is attached to the vertical plate 36 and arranged to urge the movable guide member 66 to pivot clockwise so that the roller 68 moves toward the roller 62. The guide member 66 includes a chamfered surface 76 directly above the roller 68 for a purpose that will be explained below.

Figures 1C, 2:
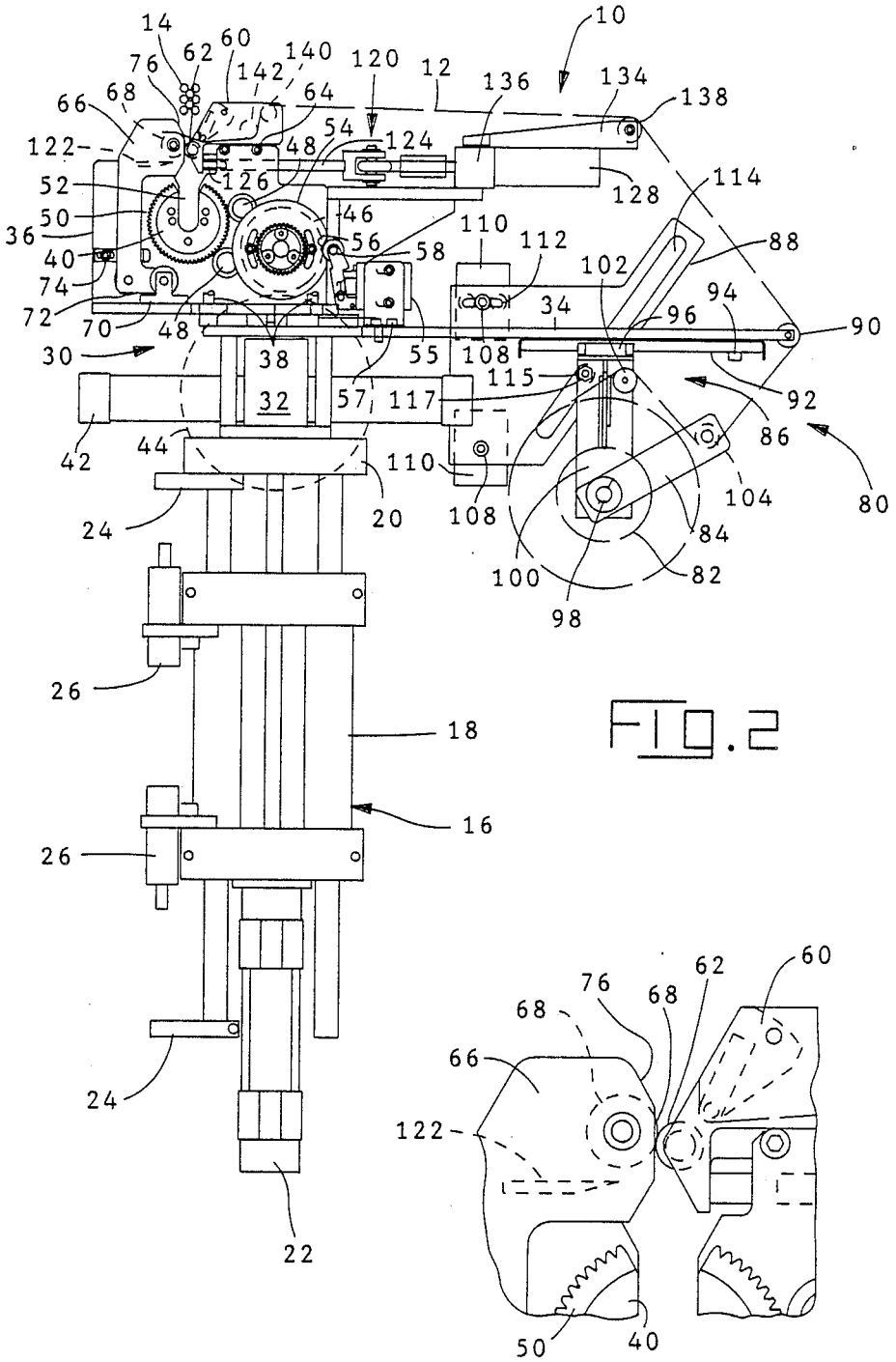
FIG. 2 is a view similar to that of FIG. 1 showing the tape wrap head advanced toward the wire bundle and the storage of slack tape.

A tape handling mechanism 80 is arranged for dispensing the proper amount of tape 12 during the tape wrap cycle and for maintaining a desired tension on the tape. To overcome the problems associated with de-reeling tape concurrently with feeding tape to the tape wrap head during wrapping, the tape handling mechanism 80 de-reels the tape and stores it. Then, the stored tape is made available to the tape wrap head. The tape handling mechanism 80 includes a tape reel 82, a take up arm 84, a slide 86, a cam plate 88, and various guide rollers. An outboard guide roller 90 is attached to the right most end of the horizontal bar 34, as shown in FIG. 1, and in alignment with the path of the tape 12. The slide 86 has a stationary portion 92, which is attached to the bar 34 by means of the screw fasteners 94, and a movable portion 96 which is arranged to move toward and away from the outboard guide roller 90. The tape reel 82 is journaled for rotation on a shaft 98 which projects from a support bracket 100, and maintains the reel 82 in alignment with the desired tape path. The support bracket 100 is attached to the movable portion 96 of the slide 86 and moves therewith along a slide path toward and away from the roller 90. A guide roller 102 is disposed on the support bracket 100 adjacent the movable portion 96 and in alignment with the tape path. The take up arm 84 is pivotally attached to the shaft 98 at one end and, at the other end, has a guide roller 104 disposed thereon that projects across the tape path. With the tape threaded as shown in FIG. 1, that is, from an endless supply of tape on the tape reel 82, the tape 12 extends up and over the roller 102, under the roller 104, and out and around the outboard roller 90, the guide roller 104 will take up and store any slack that is present in the tape 12 as shown in FIG. 2. This occurs because the major portion of the arm 84 is vertically off center from its pivot shaft 98, allowing gravity to urge the arm 84 to pivot clockwise. This results in a controlled amount of tension being applied to the tape 12 during wire bundle wrapping.

The cam plate 88 is attached, by means of the screws 108, to a pair of mounting bosses 110 which are rigidly attached to the machine and are stationary with respect to the stationary portion 18 of the slide 16. An elongated hole or slot 112 is provided through the cam plate 88 having sufficient clearance to permit the cam plate 88 to pivot about the lower screw 108 and then be locked in place by tightening the screws 108. A cam slot 114 is provided in the cam plate 88 at an angle that is less than 90 degrees with respect to the path of the movable portion 96 which is parallel to the horizontal bar 34. The angle can be adjusted slightly by pivoting the cam plate 88 about the lower screw 108. As the angle becomes less, the movement of the movable portion 96 of the slide 86 is greater for a given displacement of the frame 30. This additional travel of the slide 86 which moves the roller 102 closer to the outboard roller 90 provides additional slack in the tape. If less slack is desired, then the cam plate 88 is pivoted in the opposite direction. A cam follower 115, sized to closely fit but smoothly slide within the cam slot 114, is attached to the bracket 100 by the fastener 117 and operationally engages the slot 114. Optionally, the cam follower 115 may be attached to the movable portion 96 of the slide 86. Either arrangement will be suitable.

A tape cutter 120 includes a sharp cutting blade 122 which is attached to the vertical plate 36, a pusher 124 having a U-shaped tape engaging end 126, and an air cylinder 128. The pusher 124 is arranged in a slideway in the plate 36 so that the pusher 124 may undergo movement toward and away from the blade 122. The cylinder 128, which is connected to the pusher 124 by means of the pin and clevis 130 and turnbuckle 132, selectively imparts this motion to the pusher 124. As best seen in FIGS. 1*a* and 1*b*, when it is desired to cut the tape 12, the cylinder 128 causes the pusher 124 to translate to the left and the U-shaped end 126 to engage the tape 12. As further movement to the left occurs, the tape 12 is stretched across the sharp edge 128, severing the tape, while the free cut end 131 of the supply tape is forced against the roller 68 and adheres thereto. The other cut end is the end of a portion of tape having a selected length and which is to be wrapped about a bundle of wires, as will be described further below. The air cylinder 128 also supports a bracket 134 which is attached thereto by any suitable fasteners 136. A tape guide roller 138 is disposed in the outboard end of the bracket 134 in alignment with the tape path. Additionally, the member 60 has a pair of guide rollers 140 and 142 disposed therein as shown in FIG. 1.

In operation, a wire bundle 14, which is to be wrapped with a length of the tape 12, is presented vertically above the opening 52 as shown in FIG. 1. Note that the tape 12 emanates from the endless supply of tape on the reel 82, over the top of the roller 102, under the roller 104, around the outboard roller 90, over the rollers 138 and 140, under the roller 142 and over the rollers 62 and 68.

As the air cylinder 22 is pressurized, the entire frame 30 and tape handling mechanism 80 begin to move upwardly toward the wire bundle 14 as shown in FIG. 2. As this movement occurs, the cam follower 115 tracks the cam slot 114, causing the movable portion 96 of the slide 86 to move to the right, as viewed in FIG. 2. This causes the guide roller 102 and associated reel 82 of tape to move closer to the outboard guide roller 90, thereby causing slack in the tape 12. However, under the urging of gravity, the take up bar 84 moves downwardly as the roller 104 keeps the tape 12 taut. It will be understood that other suitable arrangements may be used for biasing the take up bar 84 in a direction to remove slack from the tape 12, such as a spring or other resilient device. Note that, as the take up bar 84 and roller 104 take up the slack in the tape 12, they are actually storing the slack tape for future use.

Figure 3:
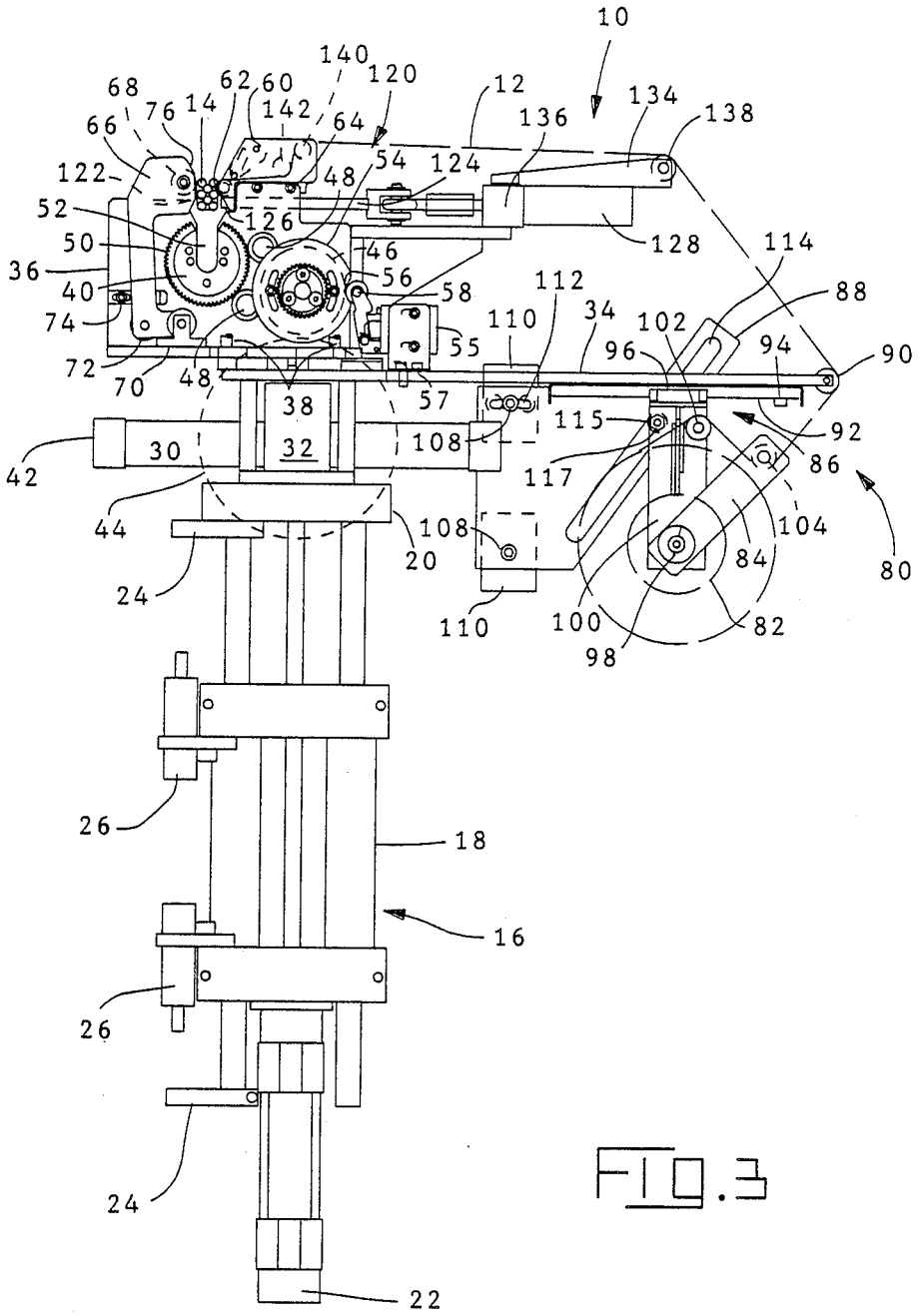
FIG. 3 is a view similar to that of FIG. 1 showing the wire bundle engaging the tape, and the dispensing of tape.

As upward motion of the frame 30 continues, the wire bundle 14 engages the chamfered surface 76, thereby camming the movable guide member 66 counterclockwise about its pivot 72 until the wire bundle 14 engages the tape 12 and enters between the two rollers 62 and 68, bringing the tape 12 with it. The adhesive side of the tape being up, the tape 12 adheres to the bottom of the wire bundle 14 and the sides thereof as it is pressed between the two rollers 62 and 68 under the urging of the spring device 74. This is best shown in FIG. 3. As this occurs, tape 12 must be drawn along the tape path as is needed to follow the bundle 14 toward the tape wrap head 40. This drawn tape is made available in two ways, the first being that as upward motion of the frame 3 continues, the follower 115 tracking the cam slot 114 causes the rollers 102 and 90 to become closer together, and the second being that some of the slack tape that is stored by the take up arm 84 is drawn off, thereby causing the take up arm 84 to pivot counterclockwise as seen in FIG. 3.

Figure 4:
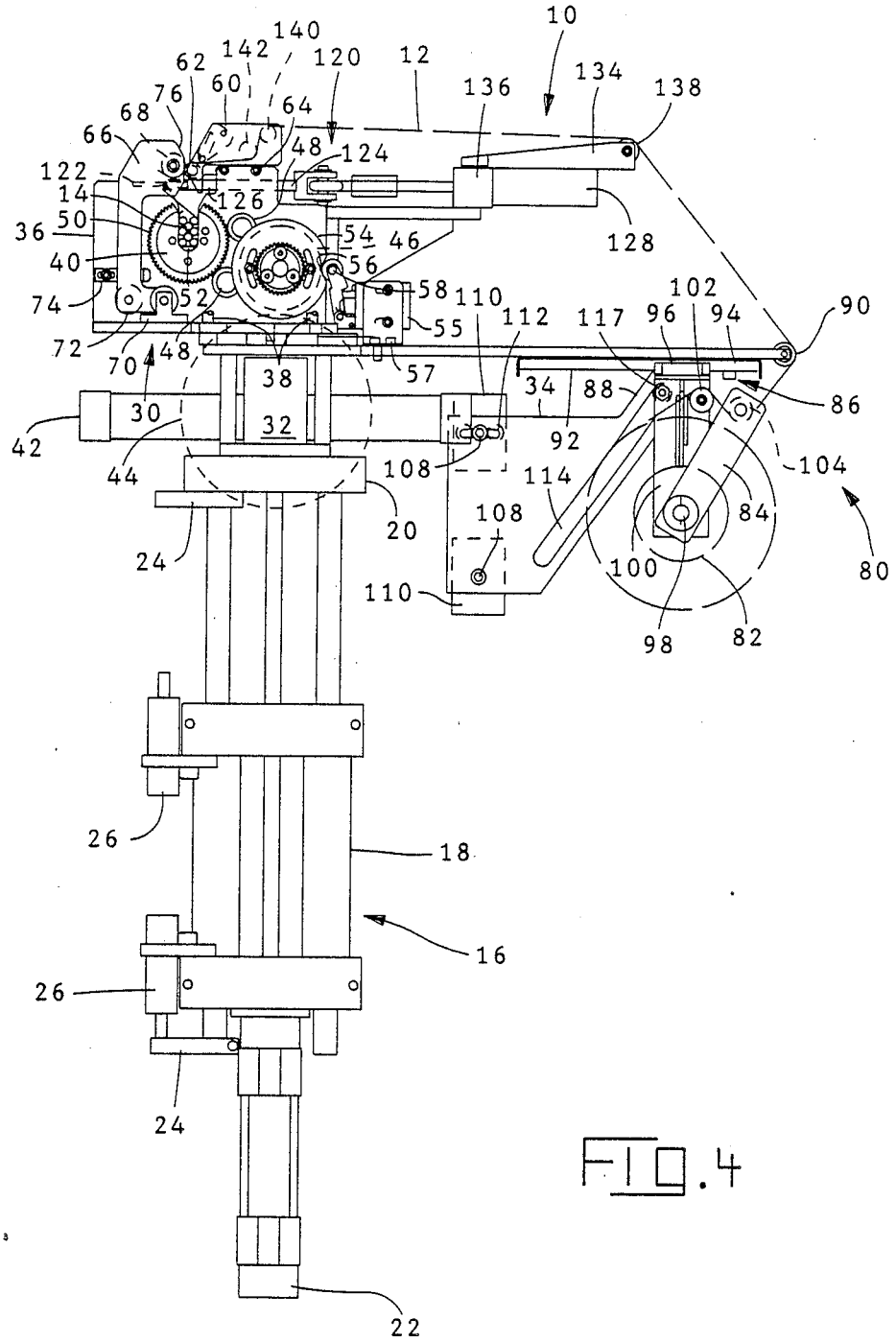
FIG. 4 is a view similar to that of FIG. 1 showing the tape cut and in position for wrapping.
Figure 5:
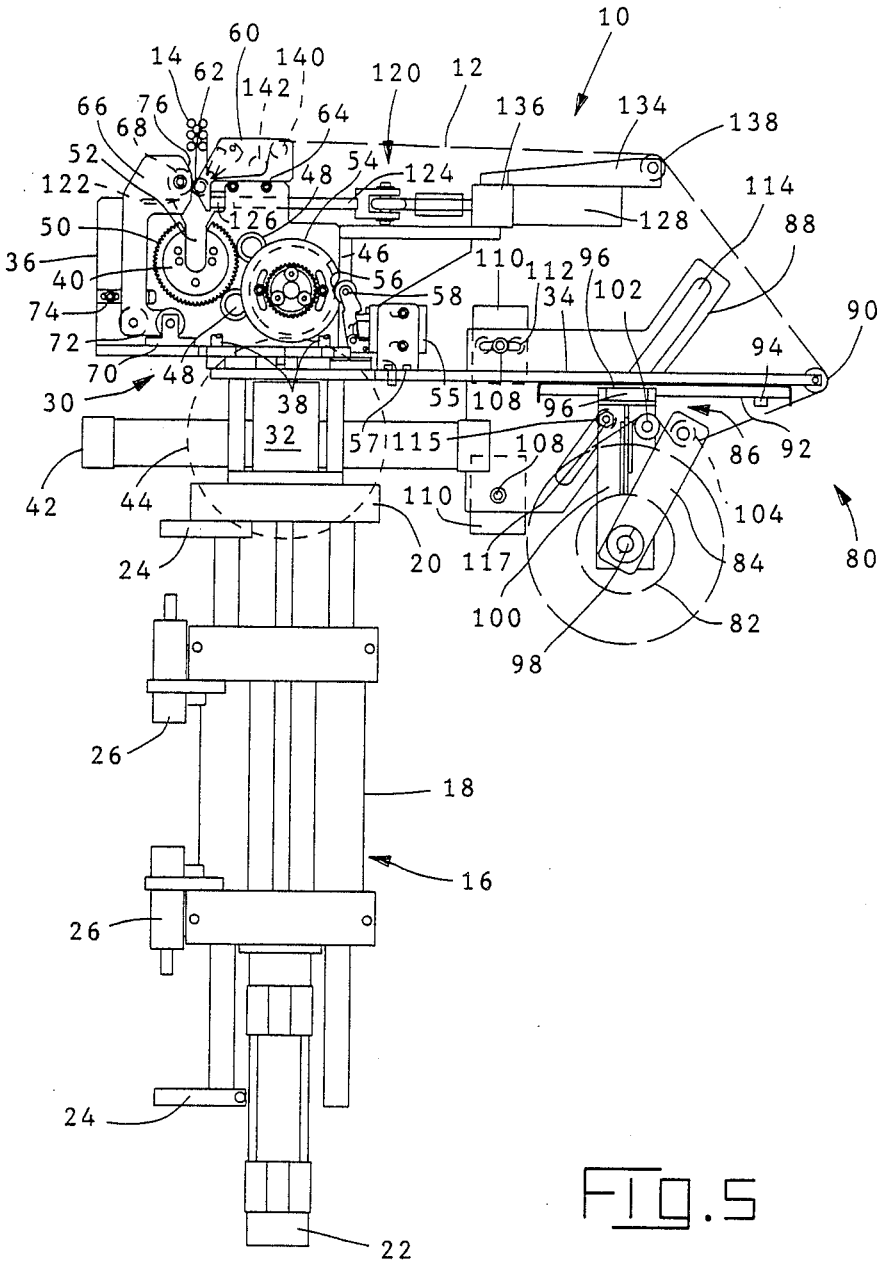
FIG. 5 is a view similar to that of FIG. 1 showing the tape head moving away from the wrapped wire bundle and the de-reeling of tape from the endless supply of tape.

As upward motion of the frame 30 continues, the wire bundle 14 enters the opening 52 until it is substantially centered on the rotational axis of the tape wrap head 40 as shown in FIG. 4. At this point, the cylinder 128 is actuated, causing the U-shaped end 126 of the pusher 124 to move toward the blade 122, engaging the tape 12 and severing it as best seen in FIG. 1*b*. The severed end 131 or free cut end of the supply end of the tape is pressed against the roller 68, thereby adhering thereto. The other severed end of the tape simply lays there for an instant. The tape wrap head is then rotated counterclockwise about four revolutions by the rotational indexer 42, thereby wrapping the severed length of tape about the wire bundle 14. Note that from the beginning of this operation, as depicted in FIG. 1, to the completion of the tape wrap, there was no tape 12 drawn off the reel 82. All of the tape 12 that was used was made available by the advancing of the roller 102 toward the outboard roller 90, thereby permitting complete control of the tension on the tape during the process.

The cylinder 22 is then reversed to cause the frame 30 to begin moving downwardly and to disengage the wire bundle 14. As this downward movement continues, the wire bundle 14 cams against the undersurface 76, causing the guide member 66 to pivot outwardly while having the end 130 of tape 12 still attached to the roller 68. As movement continues, the wire bundle 14 engages the underside of the tape 12, causing the tape end 131 to peel off of the roller 68 and flip upwardly as the apparatus 10 completely disengages from the wrapped wire bundle 14. The end 131 of tape 12 then falls down toward the roller 68 and rests on the top thereof as shown in FIG. 1. To assure that the tape end 131 falls back onto the roller 68 instead of falling toward the guide member 60, the guide member 60 may be fitted with an orifice through which low pressure compressed air may be directed to urge the tape end 131 in the desired direction. Throughout this downward movement of the frame 30, the follower 115 tracks the cam slot 114 thereby causing the movable portion 96 of the slide 86 to move to the left until it is in the position shown in FIG. 1. While this occurs, the tape 12 is prevented from withdrawing from the rollers 68 and 62 so that, as the roller 102 recedes from the outboard roller 90 additional tape 12 is de-reeled from the endless supply of tape on the reel 82. During de-reeling, the tape 12 may be prevented from withdrawing by providing a suitable pressure clamp to hold the tape against a stationery number, or, as in the present example, the guide roller 142 may be of the type that will turn in only one direction. In the present example, a Roller Clutch, part number RC 040708 manufactured by The Torrington Company of Torrington Conn. 06790 was used. The apparatus 10 is then ready to repeat the above describe tape wrapping cycle.

We claim:

1. In a machine for handling a bundle of wires, an apparatus for automatically wrapping a tape about said bundle of wires comprising:

(a) a frame;

(b) a tape wrap head journaled for rotation in said frame and movable therewith in a direction toward and into engagement with said bundle of wire and in an opposite direction;

(c) an endless supply of tape;

(d) a tape handling means for dispensing a selected length of tape from said endless supply of tape while maintaining a desired tension on said tape including means for providing slack tape and means for storing slack tape;

(e) cutter means for cutting said selected length of tape leaving a free cut end on said endless supply of tape;

wherein said means for providing slack tape comprises:

(1) a slide having a stationary portion attached to said frame and a movable portion having a bracket attached thereto;

(2) a tape reel journaled for rotation in said bracket and arranged for holding said endless supply of tape;

(3) a first tape pivot on said bracket and a second tape pivot on said stationary portion of said slide arranged so that the distance between said first and second tape pivots varies as said movable portion of said slide undergoes movement along said stationary portion; and (4) means for effecting said movement of said movable portion so that when a length of tape from said endless supply of tape is disposed about said first and second tape pivots and the distance therebetween is reduced, said slack tape is thereby provided, wherein said tape wrap head is operable to wrap said cut selected length of tape about said bundle of wires.

2. The apparatus set forth in claim 1 wherein said means for effecting said movement of said movable portion of said slide includes:

(a) a cam plate attached to said machine and having a cam surface adjacent said slide; and (b) a cam follower attached to one of said bracket and said movable potion of said slide, said cam follower being in operational engagement with said cam surface, said cam plate being disposed so that as said frame and said tape wrap head undergo said movement toward said bundle of wires, said movement of said movable portion of said slide is effected along a slide path so that the distance between said first and second tape pivots is reduced by an amount related to the angle between said cam surface and said slide path.

3. The apparatus set forth in claim 2 including means for adjusting the amount of slack tape provided comprising a pivotal attachment which pivotally attaches one end of said cam plate to the machine, and an adjustable attachment which adjustably attaches another end of said cam plate to the machine, wherein by manipulating said adjustable attachment, said cam plate is caused to pivot about said pivotal attachment thereby changing the angle between said cam surface and said slide path.

4. The apparatus set forth in claim 3 wherein said first and second tape pivots are rollers.

5. The apparatus set forth in claim 2 wherein said means for storing slack tape comprises an take up member disposed between said first and second tape pivots so that when a length of tape is disposed about said tape pivots, said take up member is arranged to engage said tape therebetween and urge a portion of said tape away from said tape pivots thereby storing slack tape..

6. The apparatus set forth in claim 5 wherein said take up member is a roller attached to one end of an arm, the other end of which is pivotally attached to said bracket.

7. The apparatus set forth in claim 6 wherein said take up member and arm are arranged so that gravity causes said arm to pivot about its pivot point thereby causing said roller to urge said portion of tape away from said tape pivots.

8. The apparatus set forth in claim 1 including means for attaching a portion of said selected length of tape to said bundle of wires.

9. The apparatus set forth in claim 8 including means for positioning said free cut end across said opening in said tape wrap head.

* * * * *